United States Patent [19]

Anzai et al.

[11] 4,127,843

[45] Nov. 28, 1978

[54] POSITION SENSOR DEVICE FOR ELEVATOR CAR

[75] Inventors: Nobuo Anzai; Tsuyoshi Satoh, both of Inazawa, Japan

[73] Assignee: Mitsubishi Denki Kabushiki Kaisha, Tokyo, Japan

[21] Appl. No.: 775,641

[22] Filed: Mar. 7, 1977

[30] Foreign Application Priority Data

Mar. 12, 1976 [JP] Japan ..... 51/26819

[51] Int. Cl.[2] ..... G08B 3/02

[52] U.S. Cl. ..... 340/21; 187/35; 187/39; 200/47; 307/119; 318/266; 318/468; 340/177 VA; 340/196

[58] Field of Search ..... 340/21, 282; 187/35, 187/36, 39; 200/47; 318/266, 468; 307/119

[56] References Cited

U.S. PATENT DOCUMENTS

| | | | |
|---|---|---|---|
| 1,169,722 | 1/1916 | Jansson | 187/36 |
| 1,949,788 | 3/1934 | Dunn | 187/35 X |
| 2,588,299 | 3/1952 | Schultz | 340/21 |
| 3,333,657 | 8/1967 | Inuzuka et al. | 187/35 |
| 3,697,707 | 10/1972 | Williams | 340/282 X |

*Primary Examiner*—David L. Trafton

[57] ABSTRACT

A position sensor disposed on an elevator car has a first rotatable shaft connected to a secondary winding of a transformer or a switch actuating member, and a second rotatable shaft coaxial with the first shaft and connected to a primary transformer winding or to a switch position changing member. A first roller engages a rod-shaped cam mounted at an angle to a guide rail for the car toward the end of the path of travel of the car to rotate the first shaft in a direction to decrease the voltage across the secondary winding or successively actuate the switches. If the car moves horizontally, the first shaft is rotated to change the voltage and a second roller engaging the rail rotates a second shaft to compensate for this change in voltage.

12 Claims, 6 Drawing Figures

POSITION SENSOR DEVICE FOR ELEVATOR CAR

BACKGROUND OF THE INVENTION

This invention relates to a position sensor device (which may also serve as a position-to-speed converter device) for use with an elevator car.

Moving members such as elevator cars are adapted to move along a path of movement having a finite length and accordingly it is a common practice to limit the speed thereof at either end of the path of movement in order to ensure that they stop at the ends of the path of movement. In elevator systems, therefore, it has been already proposed to sense the actual position of the elevator car and compare a command speed corresponding to the sensed position of the car determined by an output from a position-to-speed converter with the actual speed of the car thereby to maintain control of the car. Conventional position-to-speed converters, however, have been disadvantageous in that the position of the elevator car is sometimes erroneously sensed due to the horizontal movement of the car. This horizontal movement of the elevator car is caused due to a guiding member attached in vibration proof relationship to the car to guide the latter along an associated guide rail.

Accordingly it is an object of the present invention to provide a new and improved position sensor device for use with an elevator car which senses the position of the elevator car traveling along either end portion of its path of movement in an error free manner.

SUMMARY OF THE INVENTION

The present invention provides a position sensor device for use with an elevator car guided by a guide rail engaged by a guiding member disposed on an elevator car, the sensor device having a first roll engaging the guide rail or a first cam member disposed in a predetermined spaced position relative to the guide rail near the end of the guide rail, a second cam member disposed in a predetermined spaced position relative to the guide rail near the end of the guide rail or the first cam member, a second roller on the elevator car and engaged with the second cam member when the elevator car approaches the end of the guide rail, and a converter disposed on the elevator car and to which said two rollers are connected to produce an output in response to the relative movement between at least two elements in the converter, one of the elements being actuated by the first roller, the other element being actuated by the second roller.

Preferably, the second cam member is a cam member disposed on a plurality of supporting arms projecting from the guide rail near end of the guide rail with one end of the cam member nearer the guide rail than the other end thereof.

BRIEF DESCRIPTION OF THE DRAWINGS

The present invention will become more readily apparent from the following detailed description taken in conjunction with the accompanying drawings in which.

Throughout the Figures like reference numerals designate identical or similar components.

DESCRIPTION OF THE PREFERRED EMBODIMENTS

Figure 1:
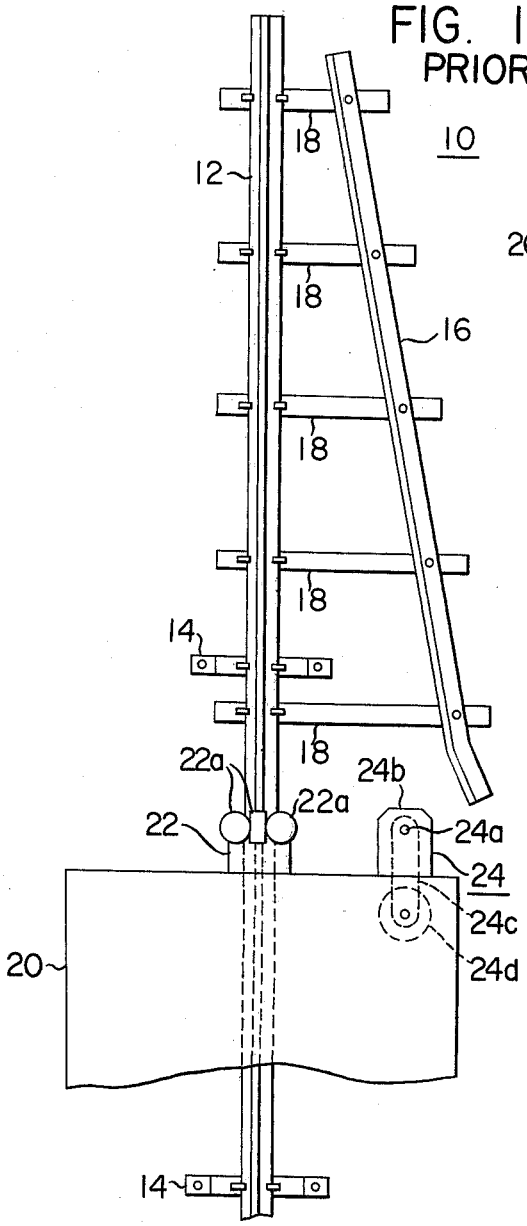
FIG. 1 PRIOR ART
FIG. 1 is a fragmental plan view of an elevator car including a conventional position sensor device and located adjacent to one end portion of an associated hoistway.

Referring now to FIG. 1 of the drawings, there is illustrated an elevator car including a conventional position sensor device and located adjacent to one end portion, in this case the upper end portion, of an elevator shaft or hoistway. The arrangement illustrated comprises a guide rail 12 (only the upper end portion of which is illustrated) vertically fixed to one wall of the hoistway generally designated by the reference numeral 10 by keeper plates 14 and a rod-shaped cam member 16 supported by a plurality of parallel cross arms 18 perpendicularly extending from the guide rail 12, the cam member 16 being positioned in spaced opposed relationship to the guide rail 12 with that end of the cam member 16 adjacent to the end of the guide rail 12 nearer the guide rail 12 than the other end thereof. A similar cam member is also disposed at the other or lower end portion of the hoistway although it it not illustrated.

In FIG. 1 an elevator car 20 is shown as being located adjacent to the upper end portion of the hoistway 10 and having a guiding member 22 attached thereto and engaging the guide rail 12. The guide member 22 illustrated here is a well known roller type guide shoe and has three rollers **22*a* mounted in vibration proof relationship on the elevator car 12 by flexible members and engaging the guide rail 12**.

A position sensor device generally designated by the reference numeral 24 is fixedly secured to the elevator car 20 on the same end as the guiding member 22 and near to that corner thereof adjacent to the cam member 16, in this case, the righthand corner as viewed in FIG. 1. More specifically, the conversion device 24 includes a horizontal shaft **24*a* rotatably disposed within a box-shaped casing 24*b* extending upwardly from the top surface of the elevator car 20, an arm 24*c* fixedly secured at one end to the shaft 24*a* and normally vertically pendent therefrom, and a roller 24*d* rotatably mounted on the other end of the arm 24*c*. The roller 24*d* is so positioned that, when the car 20 ascends from the position illustrated in FIG. 1, only the roller 24*d* abuts the rod-shaped cam member 16 and remains in contact therewith. Thus the roller 24*d* rolls along the cam member 16 while being displaced in the lefthand direction as viewed in FIG. 1, thus rotating the shaft 24*a* in the clockwise direction as viewed in FIG. 1 through the arm 24*c***.

Figure 2:
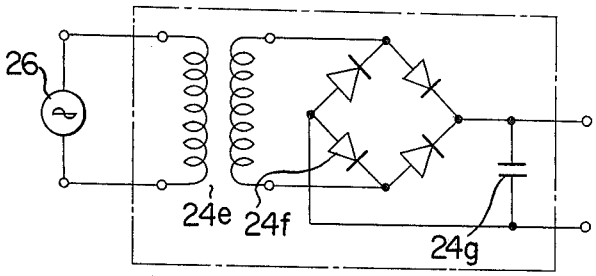
FIG. 2 is a circuit diagram of the position sensor device shown in FIG. 1.

The position sensor device 24 further includes an electric circuit as shown in FIG. 2 disposed within the casing **24*b*. In FIG. 2 a variable coupling transformer 24*e* includes a primary winding connected across a commercial source of alternating current 26 and a secondary winding connected across a pair of AC inputs to a full-wave rectifier bridge 24f** formed of four semiconductor diodes.

The bridge 24f includes a pair of DC outputs having a smoothing capacitor 24g connected thereacross to reduce ripples included in a full-wave rectified output from the bridge 24f. The shaft 24a as shown in FIG. 1 is operatively coupled to the transformer 24e so that the rotation of the shaft 24a causes a change in the degree of coupling of the transformer 24e and therefore a change in the transformation ratio of the primary to the secondary winding.

Figure 3:
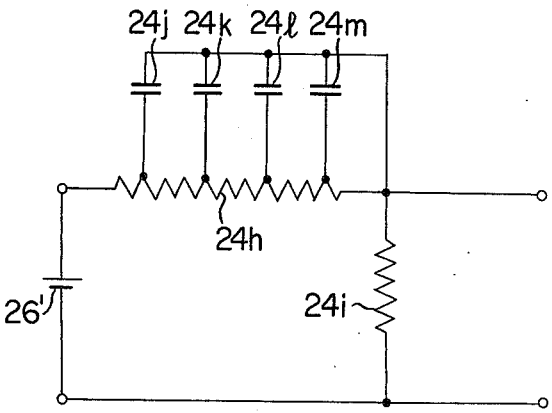
FIG. 3 is another circuit diagram of the position sensor device shown in FIG. 1.

Alternatively, the position sensor device 24 can include an electric circuit as shown in FIG. 3. In FIG. 3 a source of direct current 26' is connected across series connected resistors 24h and 24i. The resistor 24h includes a plurality in this case, four, of taps each connected to the junction of the two resistors 24h and 24i through a set of normally closed serially interconnected contacts 24j–24m. For example, the leftmost tap as viewed in FIG. 3 on the resistor 24h is connected to contact set 24j. When the car ascends along the upper end portion of the hoistway, the shaft 24a is rotated as above described to cause the contact sets 24j, 24k, 24l and 24m to be successively opened in the named order by any suitable means (not shown) with the result that the voltage across the resistor 24i is stepwise decreased.

Referring back to FIG. 1, the elevator car 20 travels upwardly and downwardly while being guided by the guide rail 12. When the car 20 moves upwardly or downwardly along the middle portion of the hoistway 10, the position sensor device 24 has the arm 24c vertically pendent as shown in FIG. 1. Assuming that the elevator car 10 travels upwardly from its position illustrated in FIG. 1, the roller 24d abuts the cam member 16 as the car ascends. Therefore, as above described, the roller 24d rolls along the rod-shaped cam member 16 while it is displaced in the lefthand direction as viewed in FIG. 1 so as to rotate the shaft 24a in the clockwise direction as viewed in FIG. 1 through the arm 24c. This clockwise rotation of the shaft 24a causes a decrease in the degree of coupling of the variable coupling transformer 24e or successive opening of contact sets 24j–24m, resulting in a decrease in the voltage output of the sensor.

From the foregoing it will be appreciated that the position-to-speed conversion device 24 is operative to convert the position of the elevator car 20 relative to the end of its travel to an angle of rotation of the shaft 24a by the utilization of the rod-shaped cam member 16 and then to indicate a corresponding speed represented by the output from the variable coupling transformer 24.

When the circuit of FIG. 3 is used, the normally closed contact sets 24j, 24k, 24l and 24m correspond to predetermined positions of the car to be sensed and are successively opened through the rotation of the shaft 24a (see FIG. 1) to develop a voltage across the resistor 24j which decreases stepwise in accordance with the position of the elevator car relative to the end of its travel. Accordingly the shaft 24a cooperates with the arrangement of FIG. 3 to produce the same type of output as the position sensor device shown in FIG. 2.

Since the guiding member 22 is supported on the elevator car 20 in vibration-proof relationship therewith, the guiding member may be deflected. This results in the displacement of the elevator car 20 relative to the guide rail 12 in opposite lateral directions as viewed in FIG. 1. This displacement of the elevator car 20 relative to the guide rail 12 causes an error in a rotational angle of the shaft 24a when the roller contacts the cam member 16. Therefore, the position sensor device of this type does not have a high accuracy.

The present invention seeks to avoid the deficiency in the prior art device as above described by the provision of a position sensor device for an elevator car which is unaffected by a lateral displacement of the elevator car relative to an associated guide rail.

One embodiment of the present invention will now be described in conjunction with FIG. 4.

Figure 4:
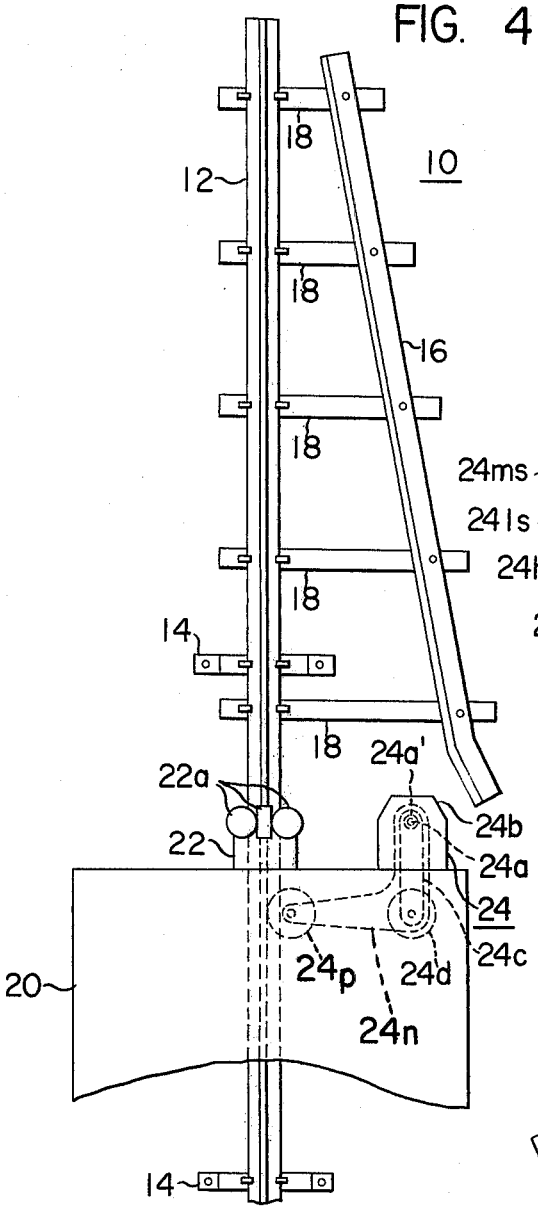
FIG. 4 is a fragmental plan view of an elevator car including a position sensor device constructed in accordance with the principles of the present invention and located adjacent to the one end portion of an associated hoistway.

In the arrangement illustrated in FIG. 4, a compensation shaft 24a' is disposed coaxially with the shaft 24a. An L-shaped arm 24n is fixedly secured at one end to the shaft 24a' so as to be rotatable about the axis of the shaft 24a' and has a compensation roller 24p rotatably mounted on the other end thereof. The roller 24p is urged against the guide rail 12 by means of a spring (not shown) acting on the arm 24n and rolls along the guide rail 12.

In other respects the arrangement is identical to that shown in FIG. 1.

The shaft 24a' is operatively coupled to one of the windings of the variable coupling transformer 24e (see FIG. 2), for example, the primary winding and the shaft 24a is operatively coupled to the other or secondary winding of the transformer 24e.

Assuming that the elevator car 20 travels upwardly from the position illustrated in FIG. 4, the roller 24d abuts the rod-shaped cam member 16. Thus, as the car 20 ascends, the shaft 24a is rotated in the clockwise direction as viewed in FIG. 4 to rotate the secondary winding in a direction to decrease the degree of coupling between the primary and secondary windings as above described. This results in a decrease in the voltage induced across the secondary winding.

On the other hand, if the traveling car 20 is displaced in the lateral direction as viewed in FIG. 4 by the deflection of the vibration-proof mounting members for the guiding member 22 resulting from the horizontal vibration of the car, this displacement of the car 20 causes the roller 24p rolling on the guide rail 12 to be horizontally deflected. For example, the elevator car 20 may be displaced with respect to the guide rail 12 in the lefthand direction as viewed in FIG. 4. This leftward displacement of the car causes the shaft 24a to be displaced in the lefthand direction along with the car 20 in spite of the roller 24d being maintained in engagement with the cam member 16. Thus the shaft 24a is minutely rotated in the counterclockwise direction as viewed in FIG. 4 with the result that the clockwise rotation of the secondary winding of the transformer 24e is correspondingly decreased.

At the same time, the roller 24p is pushed by the guide rail 12 to rotate the shaft 24a' in the counterclockwise direction as viewed in FIG. 4 through the L-shaped arm 24n. The primary transformer 24e winding is thus minutely rotated in the counterclockwise direction to compensate for the decrease in the clockwise rotation of the secondary winding as above described.

As a result, the horizontal movement of the elevator car 20 does not affect the relative rotation between the primary and secondary windings of the transformer 24e. This means that the output from the position sensor device includes no error due to horizontal movement of the elevator car.

The position sensor device as shown in FIG. 4 may utilize the circuit illustrated in FIG. 3. In this case, each of the contact sets similar to those shown in FIG. 3 is mounted on a disc fixed to the shaft 24a' so as to be rotatable therewith. As above described, the difference between the rotations of the shafts 24a and 24a' does not include a horizontal component of the movement of the elevator car and hence all the contact sets have respective operating points unaffected by the horizontal movement of the elevator car. This is true in the case where the elevator car is horizontally moved in the righthand direction as viewed in FIG. 4.

Figure 5:
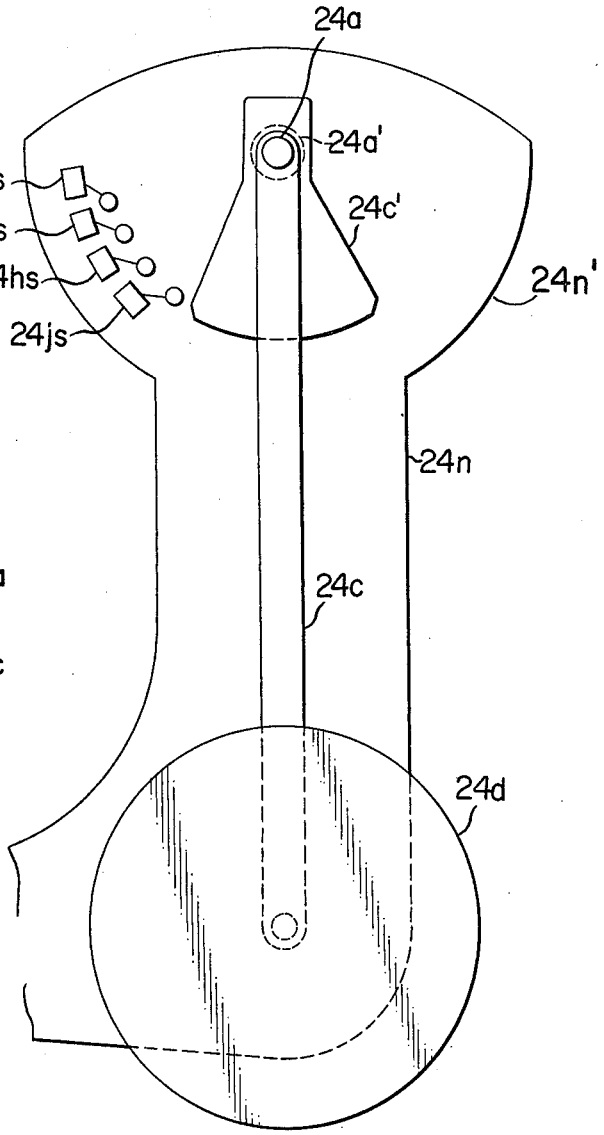
FIG. 5 is a fragmental plan view on an enlarged scale of a modification of the present invention operatively associated with the arrangement shown in FIG. 3.

FIG. 5 shows a modification of the L-shaped arm 24n connected to the shaft 24a' operatively coupled to the arrangement of FIG. 3 with the shaft 24a.

As shown in FIG. 5, that end portion 24n' of the L-shaped arm 24n fixedly secured to the shaft 24a' has an enlarged lateral dimension and is provided with an array of switches 24js, 24ks, 24ls and 24ms at such positions that the switches are successively actuated by a cam member 24c' rotated about the axis of the shaft 24a as a result of the movement of the roller 24d as above described. The switches 24js through 24ms include respective rollers and have respectively disposed therein the contact sets 24j through 24m as shown in FIG. 3 but not shown in FIG. 5.

As above described in conjunction with FIG. 4, the movement of the elevator car in the lefthand direction, for example, causes the rotation of the shaft 24a in the counterclockwise direction as viewed in FIG. 5 while at the same time the shaft 24a' is also rotated in the counterclockwise direction. Therefore, the position of cam member 24c' relative to the roller type switches 24js, 24ks, 24ls and 24ms remains unchanged. In other words, the operating point of each contact set is not affected by the horizontal movement of the elevator car.

Figure 6:
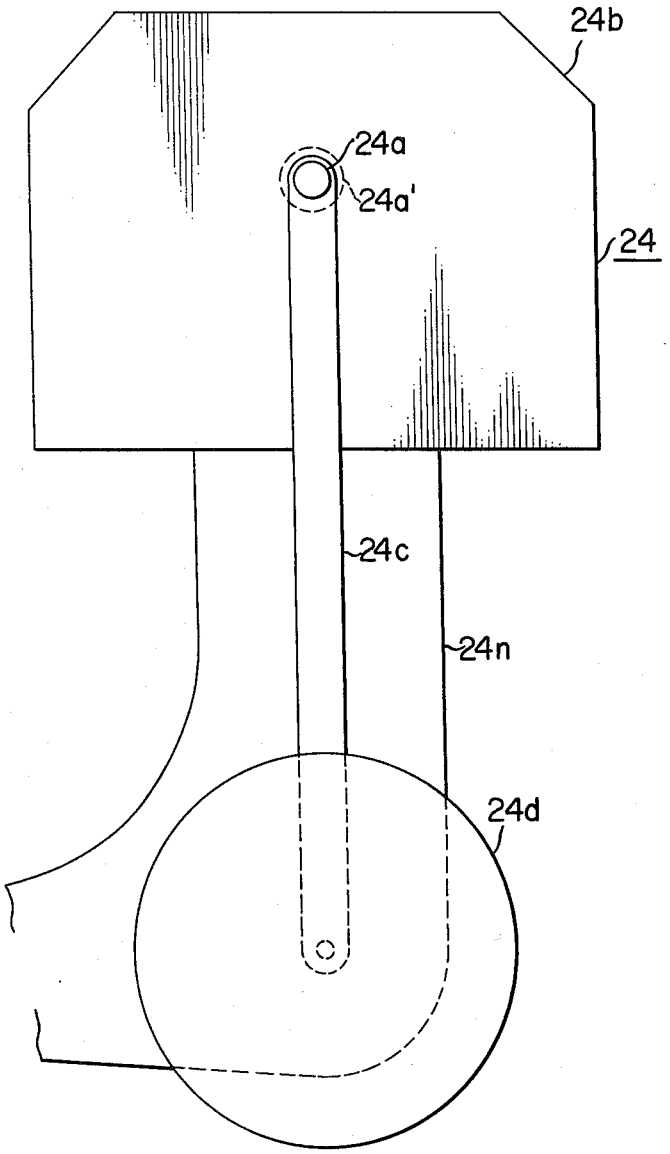
FIG. 6 is a view similar to FIG. 5 but illustrating another modification of the present invention.

In a modification of the present invention shown in FIG. 6, the position sensor device 24 is pivotally supported on the shaft 24a' above the elevator car (not shown) so as to be rotated about the axis of the shaft 24a' by means of the roller 24p (see FIG. 4) through the L-shaped arm 24n. The device 24 may include either the variable coupling transformer 24e and the associated components as shown in FIG. 2 or the contact sets 24j through 24m and the associated components as shown in FIG. 3.

As in the arrangement as shown in FIGS. 4 and 5, the position sensor device 24 as shown in FIG. 6 produces an output in response to the rotation of the device relative to the shaft 24a. Accordingly the output from the device is not affected by the horizontal movement of the elevator car.

Thus it is seen that the present invention provides a position sensor device having a simple construction and producing an output unaffected by the horizontal movement of an associated moving member such as an elevator car caused by a mating guiding member attached in vibration-proof relationship to the moving member.

While the present invention has been illustrated and described in conjunction with a few preferred embodiments thereof it is to be understood that the numerous changes and modifications may be resorted to without departing from the spirit and scope of the present invention. For example, in order to eliminate noise generated during the travel of the elevator car resulting from the roller 24p always rolling along the guide rail 12 in the arrangement of FIG. 4, the roller 24p may be kept in a position where it does not engage the guide rail 12 and only advance to the position illustrated in FIG. 4 by the rotation of the shaft 24a due to the roller 24d abutting the rod-shaped cam member 16 upon the elevator car 12 approaching the end of its travel. Also a vertical cam member in the form of a rod may be provided along the path of the elevator car with which the roller 24p engages instead of engaging the guide rail 12.

Further, while the contact sets 24j through 24m have been described as being included in the position sensor device it will readily be understood that they may serve as those contact sets required for controlling an associated elevator car for purposes other than the purpose described herein and unaffected by the horizontal movement of the car.

What we claim is:

1. A position sensor means for use with an elevator car comprising a fixed member extending parallel to the path of movement of the elevator car near the end of the path of travel of the elevator car when the elevator car nears said end of the path of travel, a first roller in contact with said fixed member and movable in response to the lateral movement of the elevator car relative to said fixed member, a cam member mounted in spaced opposed relation to said fixed member and at an angle to said fixed member, a second roller in contact with said cam member when said elevator car nears said end of the path of travel, and a converter on the elevator car having at least two elements movable relative to each other and means connected to one of said elements for producing an output in response to the movement of one of said elements and connected in response to the relative movement of said two elements, said second roller being connected to said one element for moving said one element in response to lateral movement of said second roller as the elevator car moves along said cam member, and said first roller being connected to said one of said elements for relatively moving said element in response to lateral movement of the elevator car relative to said fixed member.

2. A position sensor means as claimed in claim 1, in which said fixed member is a further cam member extending parallel to the path of the elevator car.

3. A position sensor means as claimed in claim 1 in which said cam member has the end closest to the end of the path of the elevator car nearer the fixed member than the other end of the cam member.

4. A position sensor means as claimed in claim 1 in which said fixed member is a guide member extending along the path of the elevator car for guiding the elevator car.

5. A position sensor means as claimed in claim 4 in which said cam member has the end closest to the end of the path of the elevator car nearer the guide member than the other end of the cam member, and said guide member has a plurality of supporting arms extending laterally thereof on which said cam member is mounted.

6. A position sensor means as claimed in claim 1 in which said converter includes a variable coupling transformer the primary and secondary windings of which are movable for varying the degree of coupling between the windings and said windings being the said two relatively movable elements.

7. A position sensor means as claimed in claim 1 wherein said converter includes a plurality of sets of electrical contacts positioned corresponding to positions of the elevator car to be sensed and said one element being movable for successively actuating said sets of contacts, and said other element having said sets of contacts mounted thereon.

8. A position sensor means as claimed in claim 1 further comprising separate arms each having a respective one of said rollers rotatably mounted on the free end thereof, said two relatively movable elements in said converter being relatively rotatable and having the other ends of the respective arms fixed thereto.

9. A position sensor means as claimed in claim 8 in which said converter includes a variable coupling transformer the primary and secondary windings of which are relatively rotatable for varying the degree of coupling between the windings and being the said two relatively rotatable elements.

10. A position sensor means as claimed in claim 1 further comprising separate arms each having a respective one of said rollers rotatably mounted on the free end thereof, the other ends of said arms being rotatably mounted, and said converter includes a plurality of sets of electrical contacts spaced corresponding to positions of the elevator car to be sensed, one of said relatively movable elements being on the other end of said arm having said second roller thereon and movable past said contacts for successively actuating said sets of contacts, said contacts being fixedly mounted on the other end of said arm having the first roller thereon.

11. A position sensor means as claimed in claim 1 further comprising a box member having the one of said elements to which the first roller is connected secured thereof and pivotably mounted on the elevator car for movement in response to the movement of the first roller relative to the fixed member.

12. A position sensor means as claimed in claim 1 in which said first roller is connected to said second roller for being moved into contact with said fixed member only when said second roller contacts said cam member near the end of the travel of the elevator car.

* * * * *